US005097573A

United States Patent [19]

Gimeno

[11] Patent Number: 5,097,573

[45] Date of Patent: Mar. 24, 1992

[54] FASTENING DEVICE FOR LACE-UP SHOES

[76] Inventor: Carlos V. M. Gimeno, Lorenzo Carbonell, 23, 03003 Alicante, Spain

[21] Appl. No.: 624,113

[22] Filed: Dec. 7, 1990

Related U.S. Application Data

[63] Continuation-in-part of Ser. No. 114,931, Oct. 30, 1987.

[51] Int. Cl.[5] ..... F16G 11/00

[52] U.S. Cl. ..... 24/712.6; 24/712.2; 24/712.5

[58] Field of Search ..... 24/712.6, 712.5, 712.4, 24/712.3, 712.2, 712.1, 712

[56] References Cited

U.S. PATENT DOCUMENTS

| | | | |
|---|---|---|---|
| 657,606 | 9/1900 | Lee | 24/712.6 |
| 1,363,693 | 12/1920 | Swanson | 24/712.6 |
| 2,841,849 | 7/1958 | Rice et al. | 24/712.6 |
| 3,057,029 | 10/1962 | Miller, Jr. et al. | 24/712.6 |
| 3,225,402 | 12/1965 | Altman et al. | 24/712.6 |
| 3,290,745 | 12/1966 | Maxwell et al. | 24/712.2 |
| 3,296,669 | 1/1967 | Elder, Jr. | 24/712.6 |
| 3,473,198 | 10/1969 | Meier | 24/712.3 |
| 3,500,508 | 3/1970 | Bennett | 24/712.5 |
| 4,715,094 | 12/1987 | Herdman | 24/712.3 |

FOREIGN PATENT DOCUMENTS

| | | | |
|---|---|---|---|
| 0744906 | 4/1933 | France | 24/712.3 |
| 2581846 | 11/1986 | France | 24/712.6 |
| 2066891 | 7/1981 | United Kingdom | 24/712.1 |

*Primary Examiner*—Victor N. Sakran
*Attorney, Agent, or Firm*—Kuhn and Muller

[57] ABSTRACT

Device for fastening lace up shoes, comprising a support for the shoe upper having at least one hole or slot for the passage of the ends of the laces provided at its lower part so that it is encountered close to the end holes of the shoe lacing, and lace retention means maintained fastened by means of flexible recentring members and capable of being uncoupled by exerting pressure thereon. The device has a lower concave surface coinciding with the curvature of the shoe upper on which it rests.

10 Claims, 5 Drawing Sheets

FASTENING DEVICE FOR LACE-UP SHOES

This application is a continuation in part of application Ser. No. 114,931, filed Oct. 30, 1987.

BACKGROUND OF THE INVENTION

1. Field of the Invention

The present invention relates to a device for fastening lace up shoes, enabling the tie or knot of the lacings of these shoes to be advantageously replaced.

For lace up shoes to correctly fit the user's foot, the distal ends of said laces or strings must necessarily be tied together.

This could, in principle, seem to be a trivial operation, but it is not so for unskilled users, for example, children or physically disabled persons.

These shoes present a further disadvantage since the said ties or knots become undone and they may even be untied completely, especially in the case of laces made of silk or nylon materials, with the consequent inconvenience and even a risk of falling if the loose lace ends are stepped upon.

Shoes incorporating simple or safe fastening devices are already known. Nevertheless, all those devices are based on the elimination of the lacings. However, for various reasons, inter alia fashion and design, the manufacture of lace up shoes is still necessary. Thus, shoes including parts which can be fastened by means of clasps, hooks, and even self-adhesive "velcro" type fabrics and the like are known.

2. Objects and Summary of the Invention

Thus, it is an object of the invention to provide a device by means of which the previously mentioned disadvantages are obviated.

According to the invention, the said object is accomplished inasmuch as the device comprises: A support resting on the shoe upper with at least one hole for the passage of the free ends of the laces, which hole is provided at the lower part of the said support so that it is encountered close to the end of the holes of the shoe lacing; and retention means in the said support for retaining the said laces and preventing them from being dislocated, which retention means is capable of being uncoupled in order to free the said laces urged by recentring members.

In a preferred embodiment of the invention, the said support is comprised of two parts interarticulated about a central shaft onto which they can be abated, urged by the recentring force of springs, whilst the lace retention means is comprised of lateral extensions formed at the adjacent ends of the said articulated support parts.

Alternatively, the support can be comprised of a rigid part having holes for the passage of the laces, while the retention means is comprised of an abatable pawl or bolt which retains the portions close to the free lace ends. In this embodiment the support may incorporate cavities for concealing the free ends of the laces.

According to further embodiment, the support and the retention means are constituted of a monoblock piece made of a flexible material, capable of retaining the lace ends in a stationary position or of releasing the said laces by exerting pressure on the lateral ends thereof, due to its flexible nature.

An advantageous characteristic, according to the invention, is that the lower part of the said support has a concavity, wherefore it adapts itself to the curvature of the upper part of the shoe upper on which it rests.

DESCRIPTION OF THE DRAWINGS

Other characteristics and advantages of the invention will become more apparent from the following description taken in conjunction with the accompanying drawings relative to non-limiting modes of embodiment, in which.

DESCRIPTION OF THE PREFERRED EMBODIMENT

Figure 2:
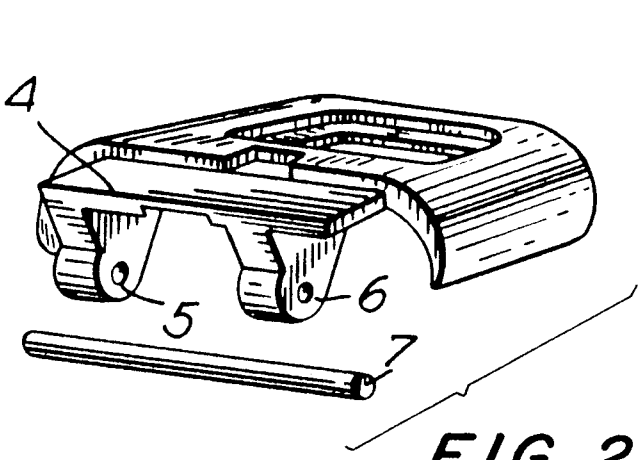
FIG. 2 is a perspective view of a basic part of the device of FIG. 1.
Figure 1:
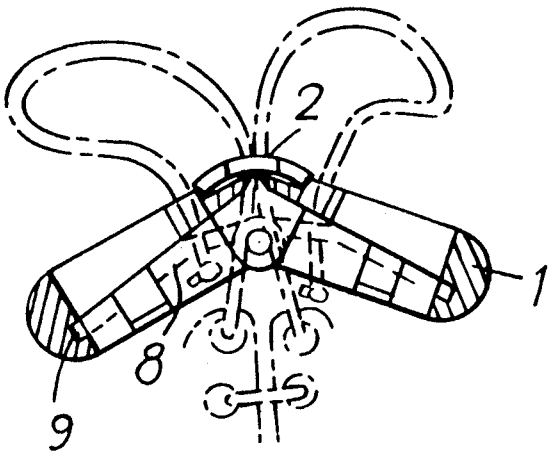
FIG. 1 is an elevational view, partly broken, of a fastening device according to the invention.

Referring to FIGS. 1 and 2, the fastening device is comprised of basic pieces 1 articulated to a bridge 2, in the center of which there is a hole 3 for the passage of the shoelaces.

The pieces 1 have ends 4 constituting the retention means, as will subsequently be explained. Additionally, the said pieces 1 form, beneath the ends 4, lugs 5 having bypass holes 6 for supporting a pin or stem 7 about which the said pieces 1 are articulated. Further, in the articulating pin or stem 7 of the pieces are mounted springs 8, the free ends of which are placed in housings 9 provided at the lower part of the pieces 1.

The bridge 2 is arranged on the pieces 1 and is fixed to the ends of the pin by means of holes 10 provided at its ends 11.

The basic pieces 1, constitutive of the support resting on the shoe upper, will be obliquely arranged, offering at the bottom of a concavity for adaptation to the curvature of the shoe upper on which they rest.

Figure 3:
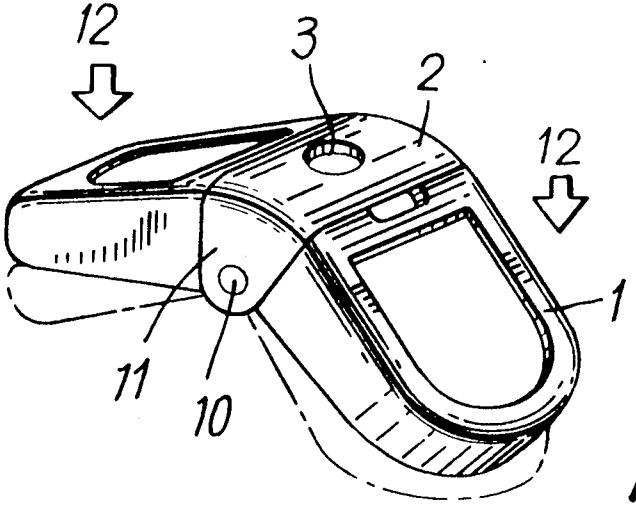
FIG. 3 show a schematically a perspective view, indicating with arrows the functioning of the device of FIG. 1.

Referring particularly to FIG. 3, it can be seen that the laces (not represented) may be fastened by exerting pressure on the pieces 1 in the direction of the arrows 12, so that they tilt downwards, as represented by the discontinuous dotted line, forming between the ends 4 a slot through which the lace ends to be retained could pass, which laces will then be lead outwards through the hole 3. Blocking of the laces will be attained by merely slackening the pressure exerted on the pieces 1, since the springs 8 will urge the support pieces 1 towards their original position. The fastening can be opened by merely exerting pressure on the device in the direction of the arrows 13, while simultaneously removing the device from the shoe upper.

Figure 5:
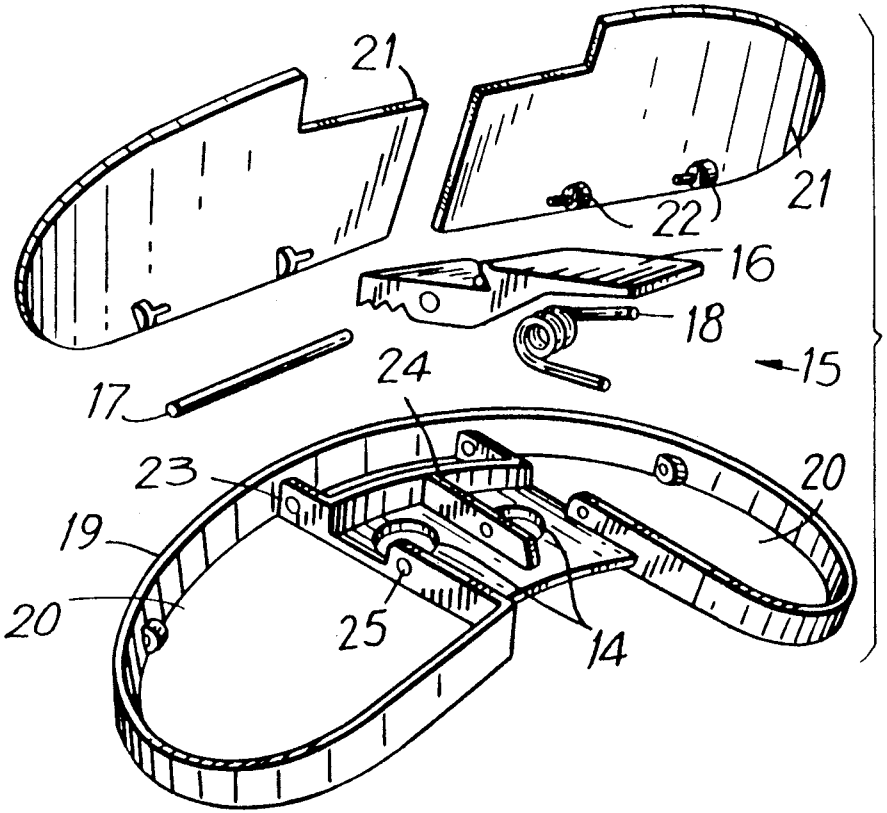
FIG. 5 is an exploded view of the alternative embodiment of the fastening device of FIG. 4.
Figure 4:
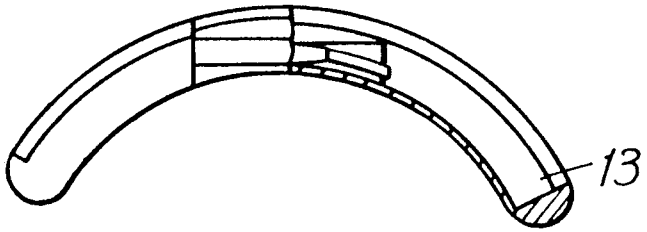
FIG. 4 is an elevational view of an alternative embodiment of the device of the invention.

As illustrated in FIGS. 4 and 5, the device of the invention comprises a support or basic piece 13, having an oblong arrangement with by-pass holes made close to its centre, and retention means 15 comprised of an abatable bolt 16 mounted in a pin 17 with a recentring spring 18 which will exert pressure upon the laces, retaining them, as will subsequently be explained.

The support 13 has a perimetral edge 19 forming cavities 20 at one side of the said by-pass holes 14 and the other. These cavities close outwards by abatable covers 21 arranged on pins 22 with the recentring springs (not represented). Further, the inner portion of the perimetral edge 19 of the support 13 is provided with hinges 23, cooperative with the said pins 22 of the covers 21, thereby forming a hinging for the said abatable covers 21.

As previously mentioned, the retention means 15 is comprised of a bolt 16 mounted in a pin 17 with a recentring spring 18. Thus, if no pressure is exerted, the said bolt 16 will be abated, concealing the holes 14 and retaining the laces passing through the said holes. The pin 17 of the retention means 15 will be centrally supported in a ribbing 24 provided on the inner part of the support 13, while its two ends are supported in holes provided on the said perimetral edge.

The basic piece or support 13 has a lower concave surface for adaptation to the curvature of the shoe upper.

Figure 7:
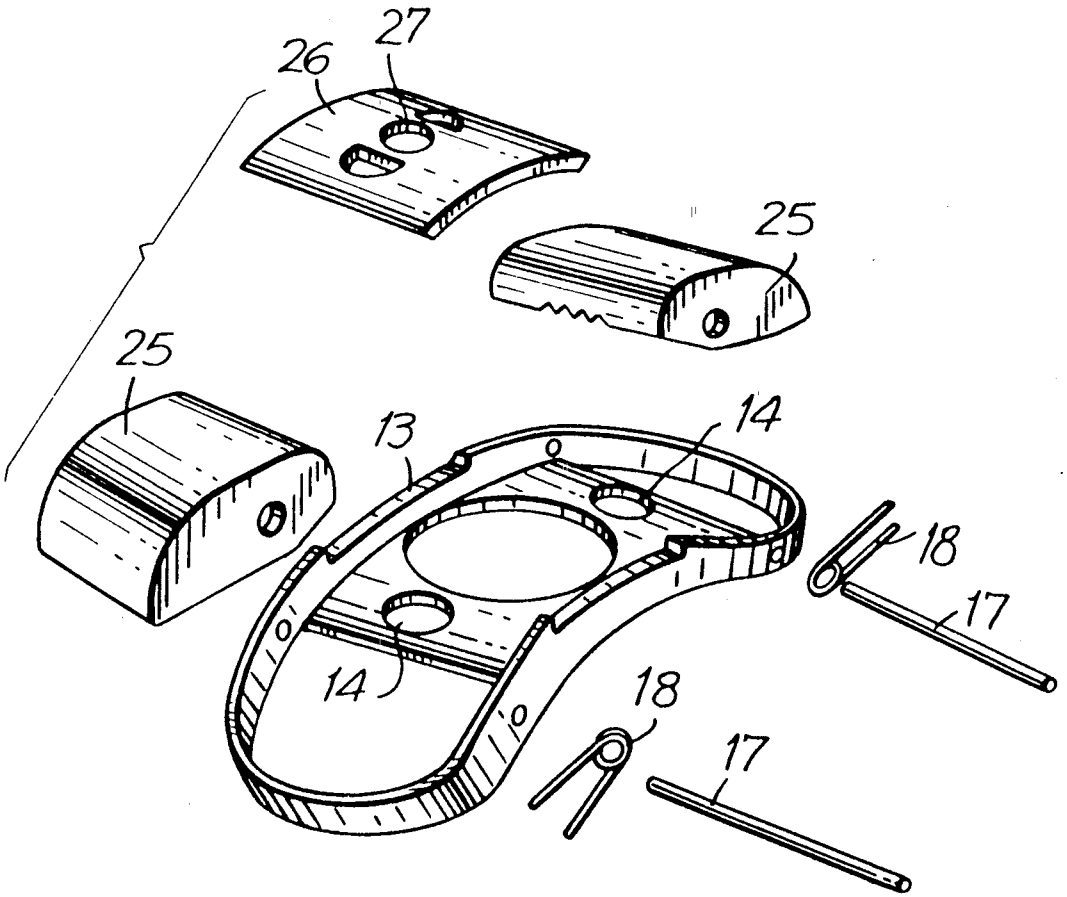
FIG. 7 is an exploded view of the fastening device of FIG. 6.
Figure 6:
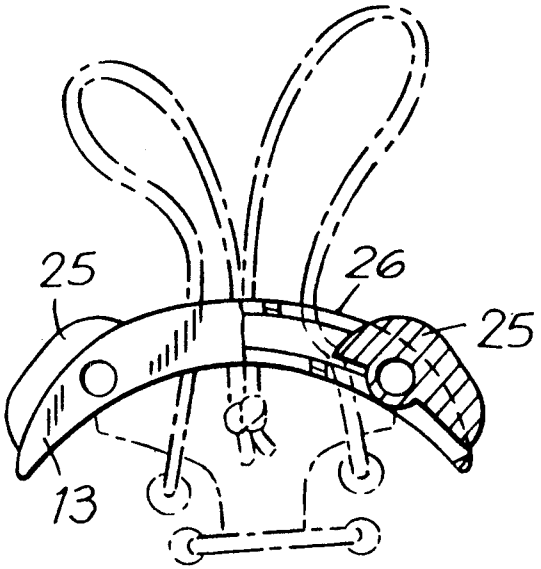
FIG. 6 is a plan view of another preferred embodiment of the invention.

As illustrated in detail in FIGS. 6 and 7, this embodiment is substantially similar to that represented in FIGS. 5 and 6, with the exception that in this case the retention means 15 is comprised of two bolts 25 encountered close to the holes 14 and similarly hinged to pins 17 and to recentring springs 18. Likewise, there is provided a plate-like piece 26 with a hole 27 for the passage of the distal ends of the laces.

Figure 9:
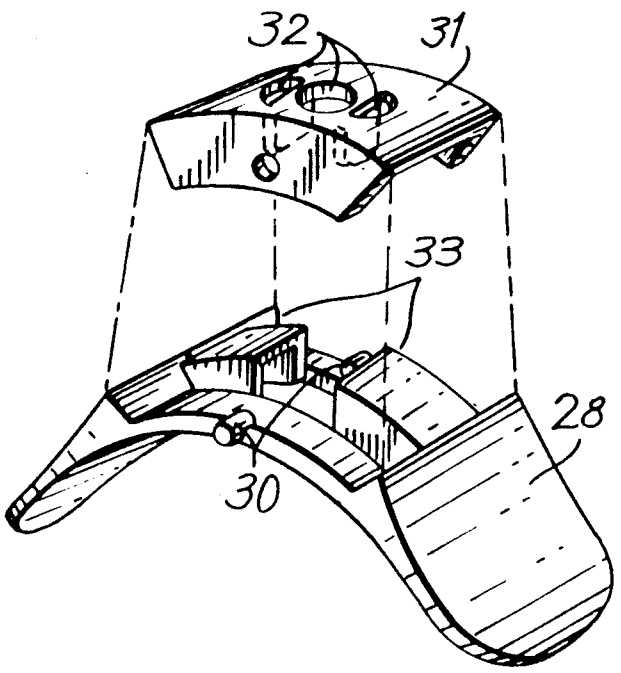
FIG. 9 is a perspective view of the device of FIG. 6, dismantled.
Figure 8:
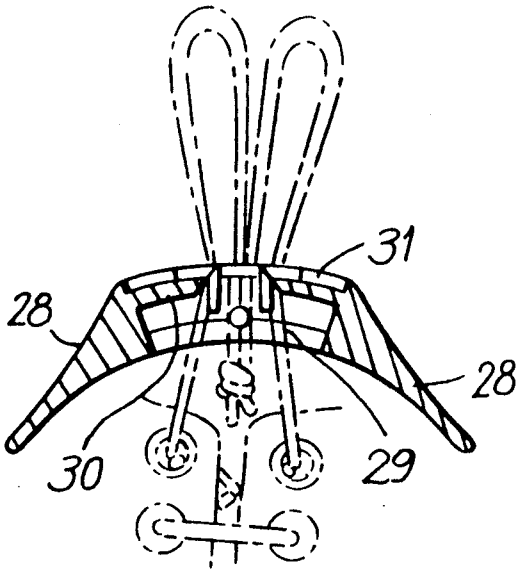
FIG. 8 is a plan view of another embodiment of the device of the invention.

Referring now to another preferred embodiment of the invention illustrated in FIGS. 8 and 9, the fastening device is comprised of a support 28 made of flexible material having a lower concave surface provided with holes 29.

Configured integrally on the upper part of the support 28 are wings 30 converging centrally over the said holes 29, forming lace retention means or members. The embodiment could include a plate or cover 31 having a hole 32 for the passage of the distal ends of the laces which will be fitted into recesses 33 provided in the wings 30.

For coupling this device to the shoe lacing with the support piece 28 pressed at its ends, the laces thereof could merely be passed through the holes 29 and in between the wings 30 and the pressure exerted could then be slackened, so that the said retaining wings may pinch or clampgrip the ends of the laces. If the cover or shield 31 is incorporated, the lace ends could merely be passed through the hole 32 of the said cover and the cover could then be fitted into the recesses 33 provided in the retaining wings 30.

Figure 11:
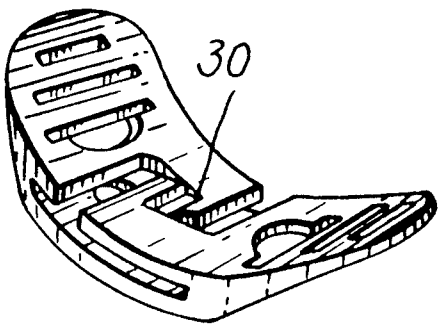
FIG. 11 is a perspective view of the bottom part of the device of FIG. 10.
Figure 10:
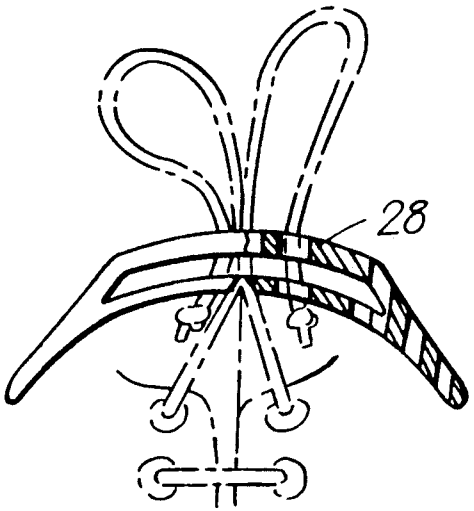
FIG. 10 is a plan view of another preferred embodiment of the invention.
Figure 12:
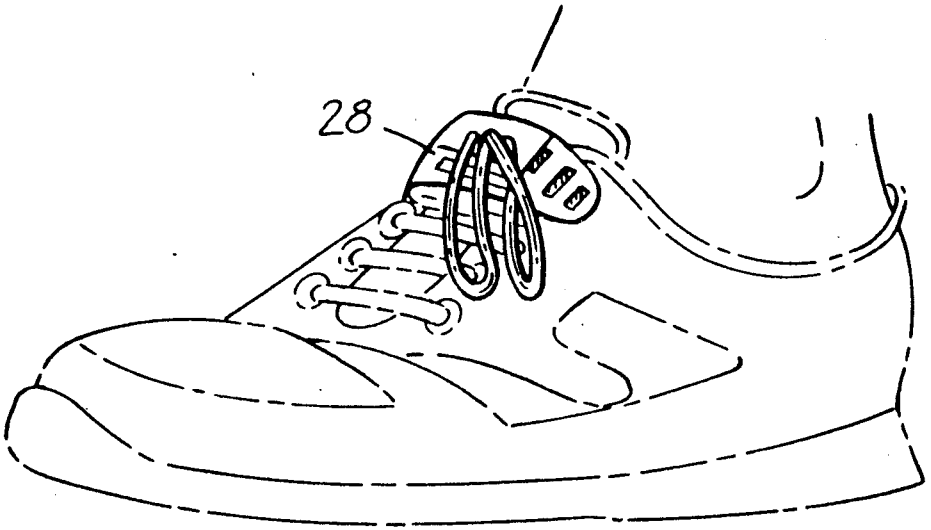
FIG. 12 shows a detail of the coupling of one of the devices of the invention to lace up a shoe.

FIGS. 10 and 11 illustrate another preferred embodiment of the invention which is substantially similar to that represented in FIGS. 8 and 9. In this embodiment the monoblock piece 28, made of flexible material and having a concave arrangement, forms integrally at its lower part flexible wing-like retention means 30 and its upper cover-like portion 31 is provided with a hole 32 for the passage of the ends of the laces. Therefore, the coupling thereof to the shoe is entirely analogous to that of the embodiment of FIGS. 8 and 9.

Any embodiment resulting from a routine experimentation of the teachings of this invention shall be deemed as comprised within the scope of this invention.

I claim:

1. Fastening device for lace up shoes, comprising:

a support resting on the upper part of the shoe upper having at least one hole formed through the surface of said support for the passage of the free ends of the shoelace or string, which said hole is provided at the lower part of the said support so that it is encountered close to the end holes of the shoe lacing;

said support having a central shaft portion and two extension member portions, said extension member portions obliquely and interarticulately arranged about said central shaft; and retention means coupled to the said support which clip or clamp-press the said laces urged by recentring members, preventing the said laces from moving or being dislocated.

2. Device according to claim 1, wherein said support is alternatively comprised of a rigid piece having cavities for housing the remaining shoelace portions, said two extension member portions obliquely and interarticulately arranged about said central shaft, said extension member portions having abatable covers for the closing of said cavities; and in that the retention means includes a centrally tilting bolt positioned over the lower hole provided in said central shaft portion of the said support piece.

3. Device according to claim 2, characterized in that the lower part of the support has a concavity coinciding with the curvature of the shoe upper.

4. Device according to claim 1, wherein said support is provided with two holes in each of said extension member portions, and two abatable bolts positioned thereabove, constituting said retention means.

5. Device according to claim 4, characterized in that the lower part of the support has a concavity coinciding with the curvature of the shoe upper.

6. Device according to claim 1, wherein said support and said retention means are integrally provided as a monoblock piece made of flexible material, said monoblock having a central shaft portion and two extension member portions obliquely and interarticulately arranged about said central shaft portion, the retention means includes centrally convergent retaining wings positioned in the central shaft portion of the support, and is capable of determining a hole for the passage of the laces by tilting over the sides of the support.

7. Device according to claim 6, characterized in that the lower part of the support has a concavity coinciding with the curvature of the shoe upper.

8. Device according to claim 1, characterized in that the lower part of the support has a concavity coinciding with the curvature of the shoe upper.

9. Fastening device for lace up shoes, comprising:

a support resting on the upper part of the shoe upper having at least one hole formed through the surface of said support for the passage of the free ends of the shoelace or string, which hole is provided at the lower part of the said support so that it is encountered close to the end holes of the shoe lacing; and said support includes two pieces, obliquely and interarticulately arranged about a central shaft on which they can be abated to alternatively conceal or reveal a hole therebetween for the passage of the laces urged by springs coupled to the said two pieces; and in that the lace retention means includes of lateral extensions provided at the adjacent ends of the said articulated pieces, so that the shoelaces are retained therebetween.

10. Device according to claim 9, characterized in that the lower part of the support has a concavity coinciding with the curvature of the shoe upper.

* * * * *